US009499893B2

(12) United States Patent
Felski et al.

(10) Patent No.: US 9,499,893 B2
(45) Date of Patent: Nov. 22, 2016

(54) METHOD OF PROCESSING TITANIUM

(71) Applicant: Monogram Aerospace Fasteners, Inc., Los Angeles, CA (US)

(72) Inventors: Paul G. Felski, Upland, CA (US); Arthur Brian McGuire, Tyler, TX (US)

(73) Assignee: Monogram Aerospace Fasteners, Inc., Los Angeles, CA (US)

( * ) Notice: Subject to any disclaimer, the term of this patent is extended or adjusted under 35 U.S.C. 154(b) by 349 days.

(21) Appl. No.: 13/804,017

(22) Filed: Mar. 14, 2013

(65) Prior Publication Data

US 2013/0251478 A1 Sep. 26, 2013

Related U.S. Application Data

(60) Provisional application No. 61/614,796, filed on Mar. 23, 2012.

(51) Int. Cl.
*C22F 1/18* (2006.01)

(52) U.S. Cl.
CPC ..... *C22F 1/183* (2013.01)

(58) Field of Classification Search
None
See application file for complete search history.

(56) References Cited

U.S. PATENT DOCUMENTS 5,681,486 A * 10/1997 Goode et al. ..... 216/67
6,814,818 B2 11/2004 Woodfield et al.

OTHER PUBLICATIONS

Chemical Milling and the Removal of Alpha Case; Jarrett Arredondo, Brenna Colleary, Stephanie Miskell, Brandon Sweet; Worchester Polytechnic Institute; Apr. 26, 2010.
Titanium Alloy Ti 6A1-4V, Aviation Database. http://www.aviation-database.com/aviation_database_pages1/Ti-6A1-4V.html (infected).
Titanium Alpha Case Prevention; Justin Chretien, Matthew King, William Proia, Stacy Rudoph; Worchester Polytechnic Institute, Apr. 27, 2010.
Titanium processing, Stan R. Seagle, Britannica Online Encylcopedia. http://www.britannica.com/EBchecked/topic/597174/titanium-processing.

* cited by examiner

*Primary Examiner* — George Wyszomierski
(74) *Attorney, Agent, or Firm* — Woodard, Emhardt, Moriarty, McNett & Henry LLP

(57) ABSTRACT

Disclosed is a method for manufacturing titanium-alloy articles that includes, before machining, heat treating a slug of titanium-alloy at a temperature sufficient to form a layer of alpha case on the surface of the slug of titanium-alloy, then, after heat treating, machining the slug of titanium-alloy to form a finished part while removing material from all surfaces of the slug of titanium-alloy.
Also disclosed is an article of manufacture made with the described method.

14 Claims, 2 Drawing Sheets

METHOD OF PROCESSING TITANIUM

BACKGROUND

Titanium and titanium-alloys are important metals for several applications. Titanium-alloys are used for aircraft and missiles where lightweight strength and high temperature performance are important. Titanium-alloys generally include a stabilizing element that alters the transformation temperature of specific metal phases in titanium to alter the material characteristics of the titanium.

Titanium and some titanium-alloys can be heat treated to increase the strength of the material. However, when titanium is exposed to high temperatures in the presence of oxygen, a hard brittle layer caused by oxygen diffusing into the titanium, called an alpha case, is formed. Alpha case is a definite drawback to titanium usage as it can affect fatigue strength, corrosion resistance, and limits titanium's high temperature capability with respect to mechanical properties. For example, while titanium is an incredibly strong metal, an alpha case layer can reduce the amount of strain that the surface can withstand before cracking. If the metal cracks it creates a stress concentration that could result in fatigue crack propagation, potentially leading to a catastrophic part failure.

Alpha case forms in a layer and does not affect the properties of the interior titanium-alloy. However, if left on a part, alpha case can cause the part to fail in applications where it would not fail if no alpha casing was present.

There are at least three ways to deal with alpha case formation on titanium: prevention, minimization, or removal. Prevention can include not exposing the titanium to high temperature, and not exposing the titanium to high temperature in the presence of oxygen. As heat treating titanium provides an advantageous increase in strength, foregoing heat treating titanium is often not an option.

Heat treating in an oxygen depleted environment is another possible solution, but it adds significant costs. In addition, it is difficult to remove 100% of the oxygen from the atmosphere, particularly in a production situation. Heat treating in an oxygen depleted environment is often more an exercise of minimizing the formation of alpha case, rather than preventing the formation of alpha case. For example, U.S. Pat. No. 6,814,818 to Woodfield et al. discloses a method of heat treating titanium-alloy articles in a vacuum furnace to limit formation of alpha case. The disclosed process requires the identification of an acceptable alpha case thickness and then seeks to limit the thickness of the alpha case by limiting the availability of oxygen during heat treating.

Removal of the alpha case is the third solution. Prior art alpha case removal methods include mechanical or chemical milling where a part is manufactured oversized, heat-treated, and then the resultant alpha case is removed from the oversized part, leaving a finished part, smaller than the oversized manufactured part initially produced.

Chemical milling consists of forged products being dipped into vessels filled with strong acids, hydrofluoric or nitric, to remove the alpha case. This process is not an ideal solution to the problem because regulations in the industry cause chemical milling to be an expensive process to maintain. It also puts the manufacturer at risk in the unlikely situation where an undesirable chemical exposure may occur. Furthermore, the spent hydrofluoric acid has to be disposed of, causing further disposal concerns. Finally, it can be difficult to ensure uniform material removal, making it difficult to control a process that removes a consistent amount of material while minimizing the amount of material removed, acid spent and process time while consistently ensuring removal of the entire alpha case layer.

Prior art mechanical milling also requires manufacture of an oversized part that is heat treated and then processed again through a mechanical milling material removal process such as cutting, grinding, abrasive blasting, electrical discharge machining, electron beam machining and ultrasonic machining to remove the alpha case layer. Such mechanical milling can be difficult to successfully implement in production because the alpha case layer is present on all surfaces, so mechanical milling has to remove a balanced quantity of material from all surfaces. For example, when refinishing the top and bottom surface on a part, it is critical that a first mechanical milling operation on the top surface removes the correct amount of material, because if too much material is removed, a subsequent mechanical milling operation on the bottom surface may leave residual alpha case material or may reduce the distance between the top and bottom surfaces below a tolerance range. Mechanical milling is also undesirable because it involves an additional pass through machining centers, significantly increasing the manufacturing costs for a part.

Furthermore, all of the prior art solutions can require quality control be performed on the finished product to ensure that no more than the acceptable amount of alpha case remains on the part. This can add additional costs to the final manufacturing cost of titanium parts.

Accordingly there is a need for an improved method to deal with alpha case on manufactured titanium parts.

DETAILED DESCRIPTION

Figure 1:
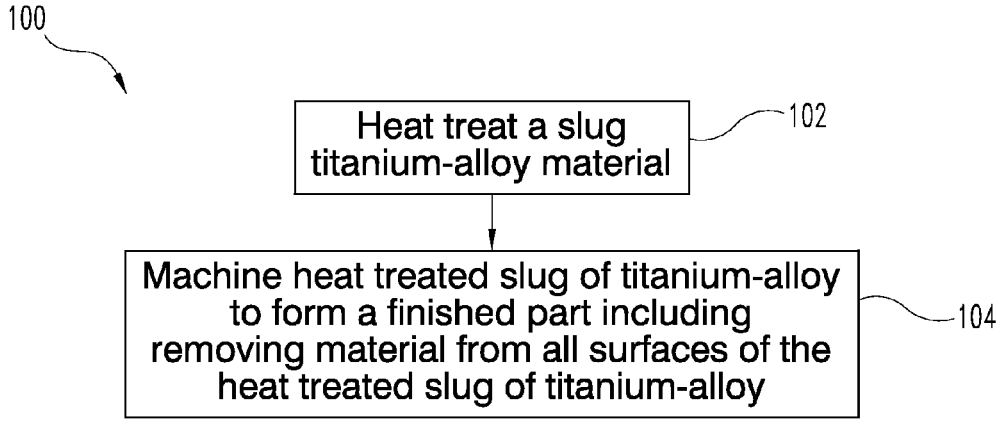
FIG. 1 is a process flow diagram illustrating a first method of processing titanium.

Reference will now be made to certain embodiments and specific language will be used to describe the same. It will nevertheless be understood that no limitation of the scope of this disclosure and the claims are thereby intended, such alterations, further modifications and further applications of the principles described herein being contemplated as would normally occur to one skilled in the art to which this disclosure relates. In several figures, where there are the same or similar elements, those elements are designated with the same or similar reference numerals.

Referring to FIG. 1, process 100 is illustrated. Process 100 begins with step 102 where, prior to machining, a slug of titanium-alloy is heat treated above 1200 degrees F. (650 degrees C.). During step 102 an alpha case layer is formed on all the exposed surfaces of the slug of titanium-alloy. Step 102 is followed by step 104 where the slug of titanium-alloy is machined to form a final part with final part dimensions.

Machining in step 104 can include any metal forming process, including, but not limited to, sawing, lathe cutting, milling, boring, drilling, grinding, abrasive blasting, polishing, electric discharge machining, electron beam machining, laser cutting and ultrasonic machining. During step 102 material is removed from all surfaces of the slug of titanium-alloy. Alpha case contamination usually only penetrates 0.001 inches (0.025 mm) to 0.002 inches (0.05 mm) deep. In one embodiment, at least 0.007 inches (0.18 mm) of material is removed from all surfaces of the slug of titanium-alloy to ensure that all alpha case is removed from the slug of titanium-alloy.

Process 100 mitigates the risk of random alpha case contamination and provides a finished surface to the completed part. Process 100 also reduces the need for subjective inspection techniques and equipment to identify microscopic variations in the surface of the finished part that indicates the presence of alpha case.

Figure 2:
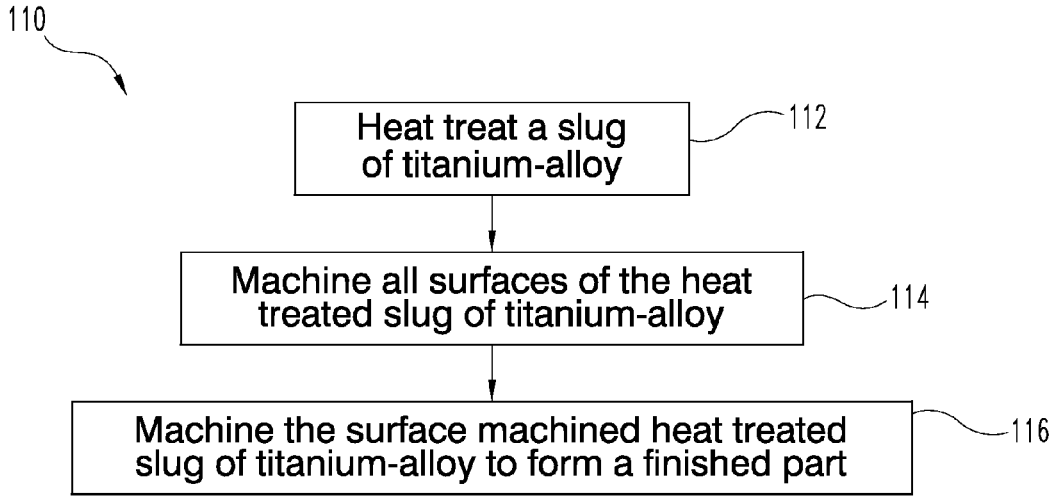
FIG. 2 is a process flow diagram illustrating a second method of processing titanium.

Referring now to FIG. 2, process 110 is illustrated. Process 110 begins with step 112 where, prior to machining, a slug of titanium-alloy is heat treated above 1200 degrees F. (650 degrees C.). During step 112 an alpha case layer is formed on all the exposed surfaces of the slug of titanium-alloy. Step 112 is followed by step 114 where all the surfaces of the slug of titanium-alloy are machined to remove a layer of material from all of the surfaces of the heat-treated slug of titanium-alloy. In one embodiment, at least 0.007 inches (0.18 mm) of material is removed from all surfaces of the slug of titanium-alloy to ensure that all alpha case is removed. Step 114 is followed by step 116 where the cleaned and heat-treated slug of titanium-alloy is machined to final part dimensions. Machining in steps 114 and 116 can include any metal forming process, including, but not limited to, sawing, lathe cutting, milling, boring, drilling, grinding, abrasive blasting, polishing, electric discharge machining, electron beam machining, laser cutting and ultrasonic machining.

The slug of titanium-alloy referred to in processes 100 and 110 refers to a piece of bulk metal roughly shaped for subsequent processing. As used herein, "slug of titanium-alloy" refers to bulk titanium-alloy that is no more than roughly shaped for production of a finished part. Included as part of this definition, a slug of titanium-alloy refers to titanium-alloy bar stock as supplied or titanium-alloy bar stock cut to a specified length. "Slug of titanium-alloy" does not refer to titanium-alloy materials that are more substantially processed, such as materials that are machined to approximate an oversized finished part.

Figure 4:
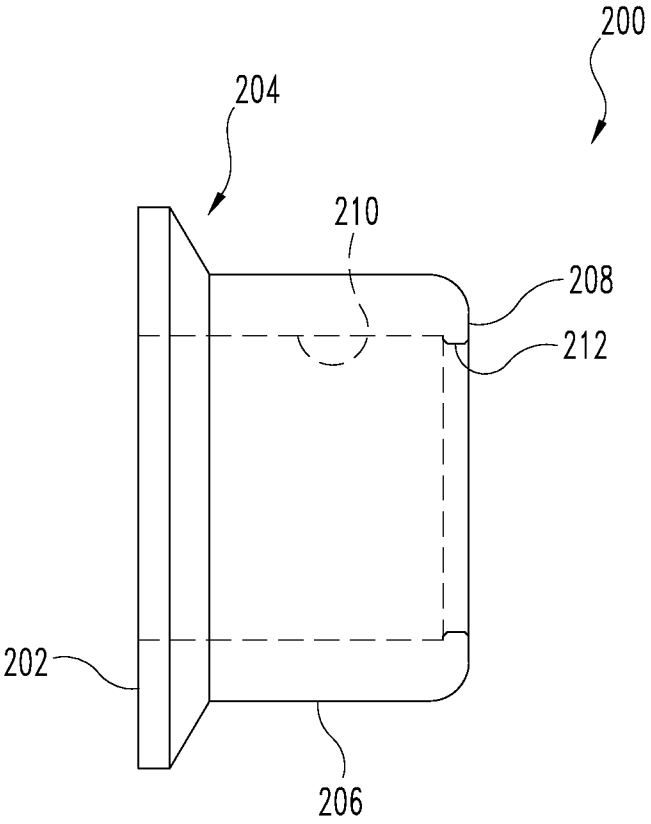
FIG. 4 is a side elevational view of the FIG. 3 shear flange collar.
Figure 3:
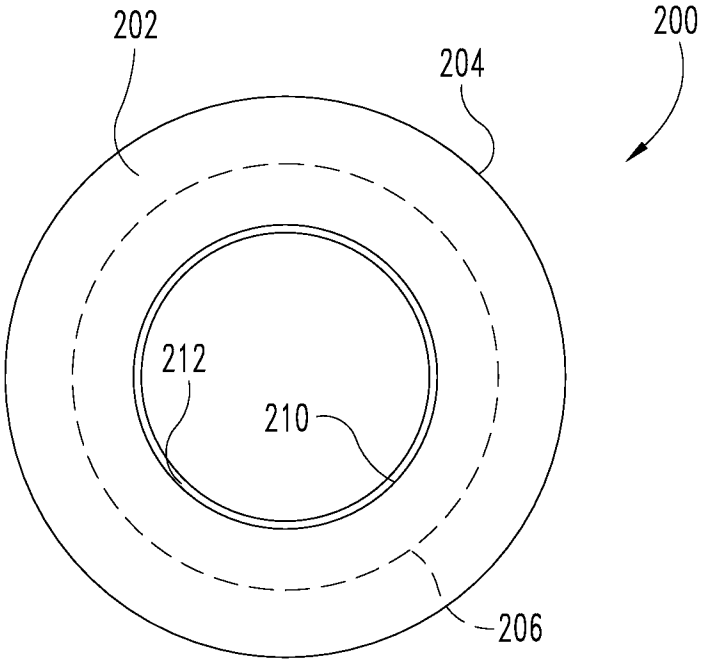
FIG. 3 is a top plan view of a shear flange collar.

Referring now to FIGS. 3 and 4, shear flange collar 200 is illustrated. Shear flange collar 200 includes bearing surface 202, head 204, outer surface 206, surface 208, bore 210 and lip 212. Surface 202 is a bearing surface that requires a smooth finish without any burrs. Shear flange collar 200 is an example of a finished part that could be manufactured with process 100 or 110. Shear flange collar 200 may be used with blind fasteners when attaching components to aircraft. Shear flange collar 200 is a non-limiting example of an article that could be manufactured from a slug of heat treated titanium-alloy using the methods described herein.

This disclosure serves to illustrate and describe the claimed invention to aid in the interpretation of the claims. However, this disclosure is not restrictive in character because not every embodiment covered by the claims is necessarily illustrated and described. All changes and modifications that come within the scope of the claims are desired to be protected, not just those embodiments explicitly described.

We claim:

1. A method for manufacturing titanium-alloy articles, the method comprising:

prior to machining, heat treating a slug of titanium-alloy;

forming a layer of alpha case on the surface of the slug of titanium-alloy;

after heat treating; machining the slug of titanium-alloy to form a finished part, wherein the machining comprises a metal forming process that cuts the slug of titanium-alloy and removes both alpha case and underlying titanium-alloy material from all surfaces of the slug of titanium-alloy.

2. The method of claim 1, wherein machining the slug of titanium-alloy to form the finished part removes at least 0.007 inches (0.18 mm) of material from all surfaces of the slug of titanium-alloy.

3. The method of claim 1, wherein the article is a component of an aircraft.

4. The method of claim 1, wherein the article is a shear flange collar.

5. The method of claim 1, wherein the slug of titanium-alloy is heat treated above 650 degrees C.

6. The method of claim 1, further comprising, prior to heat treating, cutting a titanium-alloy bar stock to a specified length to form the slug of titanium-alloy.

7. The method of claim 1, wherein the slug of titanium-alloy is a length of titanium-alloy bar stock.

8. The method of claim 1, wherein the metal forming process is selected from the group consisting of: cutting, sawing, boring, drilling, grinding, abrasive blasting, electric discharge machining, electron beam machining, laser cutting and ultrasonic machining.

9. The method of claim 1, further comprising:

after heat treating, cutting a hole through the slug of titanium-alloy to define a bore in the article.

10. A method for manufacturing titanium-alloy articles, the method comprising:

prior to machining, heat treating a slug of titanium-alloy;

forming a layer of alpha case on the surface of the slug;

after heat treating; machining the heat treated slug of titanium-alloy by a metal forming process thereby cutting both alpha case and underlying titanium-alloy material off from all surfaces of the slug of titanium-alloy; and after cutting material off from all surfaces of the heat-treated slug of titanium-alloy, forming a finished part by further machining the heat-treated slug of titanium-alloy.

11. The method of claim 10, wherein the metal forming process removes at least 0.007 inches (0.18 mm) of material from all surfaces of the slug of titanium-alloy.

12. The method of claim 10, wherein the metal forming process is selected from the group consisting of: cutting, sawing, boring, drilling, grinding, abrasive blasting, electric discharge machining, electron beam machining, laser cutting and ultrasonic machining.

13. A method for manufacturing titanium-alloy articles, the method comprising:

prior to machining, heat treating a slug of titanium-alloy;

forming a layer of alpha case on the surface of the slug;

after heat treating, cutting a hole through the slug of titanium-alloy to define a bore in the article; and after heat treating; cutting the heat treated slug of titanium-alloy by a machining process to remove both alpha case and underlying titanium-alloy material from all surfaces of the slug of titanium-alloy and shaping a finished shape of the titanium-alloy article.

14. The method of claim 13, wherein the machining process is selected from the group consisting of: sawing, lathe cutting, rotatory cutting milling, boring, drilling, grinding, abrasive blasting, and polishing.

* * * * *